US005431075A

United States Patent [19]

Cruz et al.

[11] Patent Number: 5,431,075

[45] Date of Patent: Jul. 11, 1995

[54] SWIVEL HEAD SCREWDRIVER

[75] Inventors: Jose A. Cruz, 32-43 88th St., Apt. 100, Jackson Heights, N.Y. 11369; Richard L. Miller, Dix Hills, N.Y.

[73] Assignee: Jose A. Cruz, Jackson Heights, N.Y.

[21] Appl. No.: 220,924

[22] Filed: Mar. 31, 1994

[51] Int. Cl.[6] ..... B25G 1/00; B25B 15/02

[52] U.S. Cl. ..... 81/492; 81/177.1; 81/436

[58] Field of Search ..... 81/492, 177.1, 436, 81/438–439, 489

[56] References Cited

U.S. PATENT DOCUMENTS

| | | | |
|---|---|---|---|
| 1,049,650 | 1/1913 | Benjamin | 81/436 |
| 2,550,775 | 5/1951 | Clark | 81/438 |
| 2,635,660 | 4/1953 | Dawson | 81/436 |
| 2,775,276 | 12/1956 | Rossner | 81/177.1 |
| 4,093,008 | 6/1978 | Martin | 145/61 |
| 4,729,271 | 3/1988 | Kenigson | 81/177.1 |
| 4,951,533 | 8/1990 | Hillinger | 81/177.1 |
| 5,052,253 | 10/1991 | Lin | 81/457 |
| 5,069,091 | 12/1991 | Bramsiepe et al. | 81/177.7 |

*Primary Examiner*—D. S. Meislin
*Attorney, Agent, or Firm*—Richard L. Miller

[57] ABSTRACT

A swivel head screwdriver is provided, which consists of a handle having a distal end and a proximal end. A cylindrical shank has a first end affixed within the distal end of the handle. A socket member is removably coupled to a second end of the shank. A tool tip is removably coupled to the socket member. A dome shaped head is also provided. A joint is provided having a mechanism which permits the locking or swiveling the head on the proximal end of the handle. Accordingly when the head is permitted swivel relative motion is eliminated between the head and a palm of a hand gripping the handle by transferring the motion to the swiveling joint. The result is that friction, discomfort and blisters to the palm of the hand is thereby eliminated. Alternatively when the head is locked this allow user to apply more torque to the screw driver than when the head is permitted to swivel for situation which require extreme amount of force.

3 Claims, 1 Drawing Sheet

SWIVEL HEAD SCREWDRIVER

BACKGROUND OF THE INVENTION

The instant invention relates generally to screwdrivers and more specifically it relates to a swivel head screwdriver.

Numerous screwdrivers have been provided in prior art that are adapted to include specially fabricated handles for better gripping and to allow the shanks to rotate about the handles. For example, U.S. Pat. Nos. 4,093,008 to Martin; 4,729,271 to Kenigson; 4,951,533 to Hillinger; 5,052,253 to Lin and 5,069,091 to Bramsiepe et al. all are illustrative of such prior art.

While these units may be suitable for the particular purpose to which they address, they would not be as suitable for the purposes of the present invention as heretofore described.

SUMMARY OF THE INVENTION

A primary object of the present invention is to provide a swivel head screwdriver that will overcome the shortcomings of the prior art devices.

Another object is to provide a swivel head screwdriver that will allow a head of a proximal end of a handle to swivel, thereby eliminating relative motion between the head and a palm of a hand by transferring it to a swiveling joint, so that there is no friction, discomfort or blisters to the palm.

An additional object is to provide a swivel head screwdriver in which the head in certain circumstances can be locked to the handle, to prevent the head from swiveling.

A further object is to provide a swivel head screwdriver that is simple and easy to use.

A still further object is to provide a swivel head screwdriver that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

Figure 1:
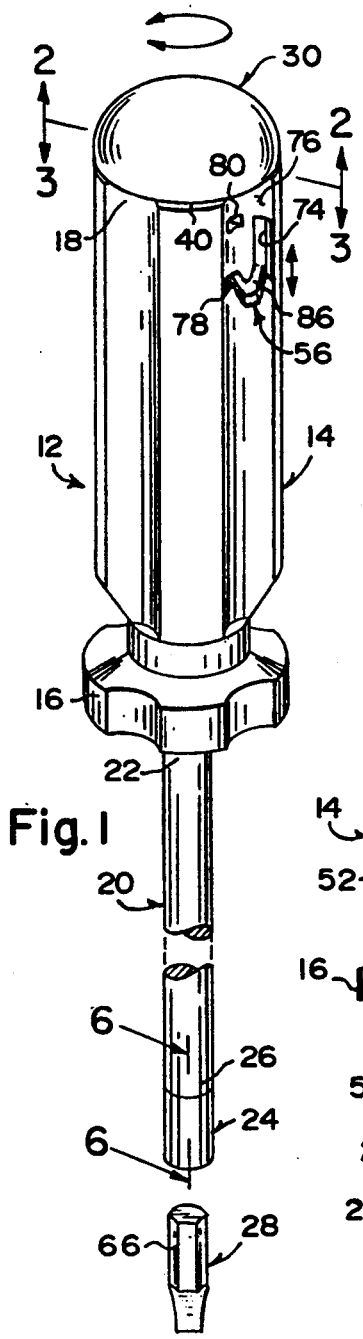
FIG. 1 is a perspective view of the instant invention with parts broken away.
Figure 2:
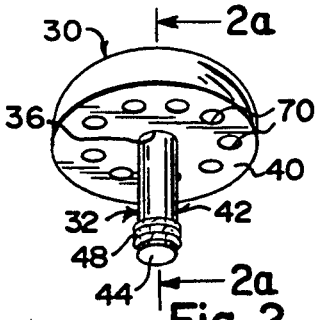
FIG. 2 is a perspective view taken generally in the direction of arrows 2—2 in FIG. 1 illustrating the swivel head construction of the instant invention.
Figure 2A:
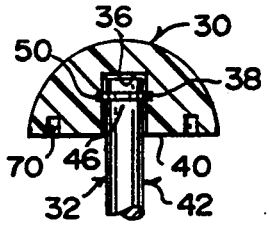
Figure 3:
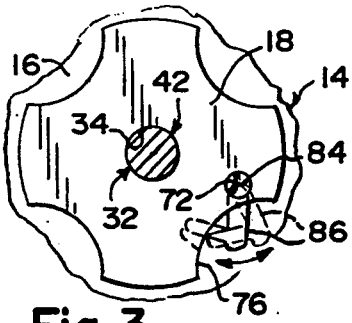
Figure 4:
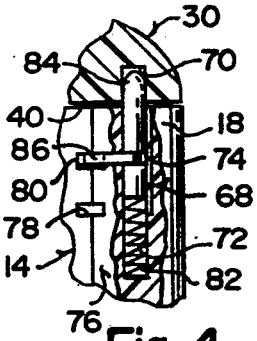
Figure 5:
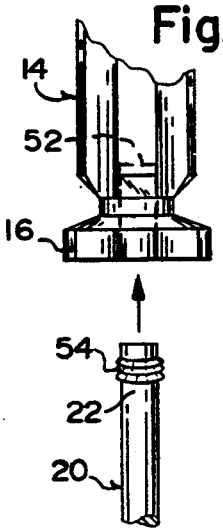
Figure 6:
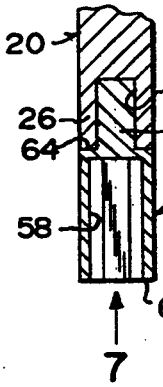
Figure 7:
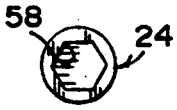
Figure 9:
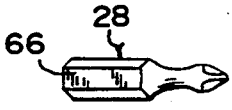
Figure 8:
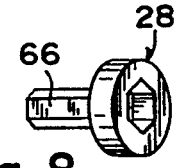
Figure 10:
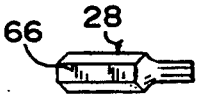

FIG. 2*a* is a diagrammatic partial cross sectional view with parts broken away taken on line 2*a*—2*a* of FIG. 2;

FIG. 3 is as an enlarged plan view partially in section and with parts broken away taken on line 3—3 of FIG. 1;

FIG. 4 is a diagrammatic elevational view of a portion thereof partially sectioned showing the locking mechanism therein;

FIG. 5 is a diagrammatic exploded elevational view illustrating the attachment assembly of the shank to the handle;

FIG. 6 is an enlarged cross sectional view taken on line 6—6 of FIG. 1;

FIG. 7 is a bottom view taken in the direction of arrow 7 in FIG. 6; and FIGS. 8, 9 and 10 are diagrammatic perspective views of typical tool tips used with the instant invention,

DETAILED DESCRIPTION OF THE PREFERRED EMBODIMENTS

Turning now descriptively to the drawings, in which similar reference characters denote similar elements throughout the several views, FIG. 1 illustrates a swivel head screwdriver 12, which consists of a handle 14, having a distal end 16 and a proximal end 18. A cylindrical shank 20 has a first end 22 affixed within the distal end 16 of the handle 14. A socket member 24 is removably coupled to a second end 26 of the shank 20 (see FIG. 5). A tool tip 28 is removably coupled to the socket member 24. A dome shaped head 30 is also provided. A joint 32, shown in FIGS. 2, 2*a* and 3 is for swiveling the head 30 on the proximal end 18 of the handle 14, thereby eliminating relative motion between said head 30 and a palm of a hand gripping the handle 14, by transferring the motion to the swiveling joint 32. Accordingly friction, discomfort and blisters to the palm of the hand, are eliminated.

The swiveling joint 32 includes the proximal end 18 of the handle 14 having a central bore 34 therein. The head 30 has a central aperture 36 with an annular groove 38 extending within a flat surface 40 of the head 30. A shaft 42 is provided having a first end 44 and a second end 46. A plurality of annular anchor ribs 48 are on the first end 44 of the shaft 42, for retaining the first end 44 of the shaft 42 in a stationary position within the central bore 34 in the proximal end 18 of the handle 14. An annular flange 50 is on the second end 46 of the shaft 42, to rotatively fit to the annular groove 38 for retaining the second end 46 of the shaft 42 in a swiveling position within the central aperture 36 within the flat surface 40 of the head 30.

As shown in FIG. 5, the distal end 16 of the handle 14 has a central opening 52 therein. A plurality of annular anchor ribs 54 are on the first end 22 of the shank 20, for retaining the first end 22 of the shank 20 in a stationary position within the central opening 52 in the distal end 16 of the handle 14.

The cylindrical shank 20, as shown in FIGS. 6 and 7, has a polygonal bore 58 at a first end 60 and a stem 62 at a second end 64, to fit into the orifice 56 in the shank 20 in a stationary manner. The tool tip 28, as shown in FIGS. 1 and 8 through 10, has a polygonal shank 66 to fit into the polygonal bore 58 in the socket member 24. The tool tip 28 in FIG. 1, is for a slotted fastener head, in FIG. 8 for a hex fastener head, in FIG. 9 for a phillips fastener head and in FIG. 10 for a torx fastener head.

A mechanism 68, shown in FIG. 4, is for locking the head 30 to the proximal end 18 of the handle 14, to prevent rotation of the head 30 thereabout. The locking mechanism 68, shown in FIGS. 2, 2*a* and 4, consists of the head 30 having a plurality of apertures 70 radially spaced about the central aperture 36 in the flat surface 40 of the head 30. The proximal end 18 of the handle shown in FIGS. 1, 3 and 4, has a longitudinal hole 72 with a portion 74 of the hole 72 slotted to an outer surface 76 and two recesses 78, 80 adjacent the slotted portion 74 of the hole 72. A spring 82 fits into the hole 72. A pin 84 is inserted into the hole 72 onto the spring 82. The spring 82 will normally bias the pin 84 upwardly into one aperture 70 in the head 30. A bent arm 86 transversely pivots on the pin 84 in the slotted portion 74 of the hole 72.

In a first instance, the bent arm 86 can enter the lower recess 78, to disengage the pin 84 from the aperture 70, to allow the head 30 to swivel. In a second instance, the bent arm 86 can enter the upper recess 80, to allow the pin 84 to enter one aperture 70 and prevent the head 30 from swiveling.

OPERATION OF THE INVENTION

To use the swivel head screwdriver 10, the bent arm 86 is placed into the lower recess 78. This will disengage the pin 84 from any of the apertures 70 in the head 30. The head 30 will be able to now swivel on the shaft 42. When the hand of a person grips the handle 14, the palm will rest on the head 30, so that there is no friction between the head 30 and the palm. The bent arm 86 can also be placed into the upper recess 80, as shown in FIG. 4. This will cause the pin 84 to enter one of the apertures 70 in the head 30, to stop the head 30 from swiveling, an accordingly allow user to apply more torque to the screw driver than when the head is permitted to swivel for situation which require extreme amount of force.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A swivel head screwdriver which comprises:

a) a handle having a distal end and a proximal end;

b) a shank having a first end affixed within said distal end of said handle; further including:

i) said distal end of said handle having a central opening therein; and ii) a plurality of annular anchor ribs on said first end of said shank, for retaining said first end of said shank in a stationary position within said central opening the said distal end of said handle;

c) a socket member removably coupled to a second end of said shank;

d) a tool tip removably coupled to said socket member;

e) a dome shaped head; and f) means for swiveling said head on said proximal end of said handle, thereby eliminating relative motion between said head and a palm of a hand gripping said handle by transferring the motion to said swiveling means, so that there is no friction, discomfort and blisters to the palm of the hand, wherein said swiveling means includes:

i) said proximal end of said handle having a central bore therein;

ii) said head having a central aperture with an annular groove extending within a flat surface of said head;

iii) a shaft having a first end and a second end;

iv) a plurality of annular anchor ribs on said first end of said shaft, for retaining said first end of said shaft in a stationary position with said central bore in said proximal end of said handle;

v) an annular flange on said second end of said shaft to rotatively fit in said annular groove for retaining said second end of said shaft in a swiveling position within said central aperture within said flat surface of said head;

vi) said shank having an orifice in said second end;

vii) said socket member having a polygonal bore at a first end and a stem at a second end, to fit into said orifice in said shank in a stationary manner;

viii) said tool tip having a polygonal shank, to fit into said polygonal bore in said socket member; and ix) means for locking said head to said proximal end of said handle, to prevent rotation of said head thereabout.

2. A swivel head screwdriver as recited in claim 1, wherein said locking means includes:

a) said head having a plurality of apertures radially spaced about said central aperture in said flat surface of said head;

b) said proximal end of said handle having a longitudinal hole with a portion of said hole slotted to an outer surface and two recesses adjacent said slotted portion of said hole;

c) a spring to fit into said hole;

d) a pin inserted into said hole onto said spring, so that said spring will normally bias said pin upwardly into one said aperture in said head; and e) a bent arm which transversely pivots on said pin in said slotted portion of said hole, so that in a first instance said bent arm can enter said lower recess to disengage said pin from said aperture to allow said head to swivel and in a second instance said bent arm can enter said upper recess to allow said pin to enter one said aperture and prevent said head from swiveling.

3. A swivel head screwdriver having means for locking said head to a proximal end of a handle, to prevent rotation of said head thereabout, wherein said locking means includes:

a) said head having a plurality of apertures radially spaced about a central aperture in a flat surface of said head;

b) said proximal end of said handle having a longitudinal hole with a portion of said hole slotted to an outer surface and two recesses adjacent said slotted portion of said hole;

c) a spring to fit into said hole;

d) a pin inserted into said hole onto said spring, so that said spring will normally bias said pin upwardly into one said aperture in said head; and e) a bent arm which transversely pivots on said pin in said slotted portion of said hole, so that in a first instance said bent arm can enter said lower recess to disengage said pin from said aperture to allow said head to swivel and in a second instance said bent arm can enter said upper recess to allow said pin to enter one said aperture and prevent said head from swiveling.

* * * * *